United States Patent [19]

Köbel

[11] 4,048,999

[45] Sept. 20, 1977

[54] TWO-CHAMBER MIXING SYRINGE

[75] Inventor: Erich Köbel, Darmstadt, Germany

[73] Assignee: Merck Patent Gesellschaft mit beschrankter Haftung, Darmstadt, Germany

[21] Appl. No.: 704,631

[22] Filed: July 12, 1976

[30] Foreign Application Priority Data

| | | |
|---|---|---|
| July 24, 1975 | Germany | 2533036 |
| Oct. 17, 1975 | Germany | 2546495 |

[51] Int. Cl.[2] ..... A61J 1/00

[52] U.S. Cl. ..... 128/272.1

[58] Field of Search ..... 128/272, 272.1, 272.3, 128/218 R, 218 M; 141/2, 27, 382–386; 206/219

[56] References Cited

U.S. PATENT DOCUMENTS

| | | | |
|---|---|---|---|
| 2,660,171 | 11/1953 | Dickinson, Jr. | 128/272 |
| 2,869,745 | 1/1959 | Lockhart | 128/272 X |
| 3,330,281 | 7/1967 | Visser | 128/272.1 |
| 3,332,421 | 7/1967 | King et al. | 128/272.1 |
| 3,392,726 | 7/1968 | Pochyla et al. | 128/272.1 |

*Primary Examiner*—John D. Yasko

*Attorney, Agent, or Firm*—Millen & White

[57] ABSTRACT

A two-chamber syringe assembly for medicinal purposes consisting of a piston syringe having a chamber for a liquid; a container as a second chamber for a solid or another liquid; a stopper with an axial bore connecting the syringe to the vial; and a second stopper sealing the axial bore and adapted to be ejected with the liquid in the syringe into the container by inward activation of the piston of the syringe.

9 Claims, 6 Drawing Figures

TWO-CHAMBER MIXING SYRINGE

BACKGROUND OF THE INVENTION

This invention relates to a device which permits two components, at least one of which is a liquid, which are intended to be injected simultaneously, to be stored separately and mixed together in the same device.

Devices already available for this purpose all have one or more serious disadvantages.

In a two-chamber syringe described in German Patent Specification No. 1,791,012, the two chambers, one of which is constructed as a syringe, are connected by a slidable tube. This piece of tube slides so as to push out a seal between the chambers, whereupon the components can be mixed and drawn into the syringe. The disadvantage of this device is that construction of the connecting part is very laborious because the slidable piece of tube requires very precise finishing, especially for a vacuum-tight construction. A further disadvantage is that this device cannot be processed in an automated lyophilizing plant.

A device is described in French Patent Specification No. 1,201,070 in which a vessel is divided into two chambers by a constriction, which can be closed by a stopper. The stopper can be forced out of the constriction by piercing a closure membrane with a syringe and forcing air into one chamber, so that the two chambers are joined. This device cannot be produced or used in a lyophilization plant, which is a serious disadvantage with respect to maintaining sterile conditions during filling. Further problems are the difficulty of producing a vessel with such a precisely finished construction and fragmentation, i.e., release into the components of particles of membrane resulting from piercing the membrane. Thus, this device appears impractical for mass production.

Therefore, there is a present need for two-chamber mixing syringes which are dependable in use, simple to operate and inexpensive to produce and fill.

SUMMARY OF THE INVENTION

A two-chamber syringe assembly for initially isolating a first liquid component to be provided in one chamber thereof from a second component to be provided in a second chamber thereof and thereafter mixing the two components; comprising a piston and cylinder type syringe having an axially-bored dispensing fitting at one end of the cylinder, with the cylinder forming a chamber for the liquid component when the piston is in outward retracted position at the opposite end of the cylinder; a container providing a second chamber for the second component and having an opening at one end; a first axially bored resilient stopper in the form of a sleeve, with one end thereof adapted for sealed engagement with the open end of the container and the bore thereof adapted for mounting the dispensing fitting of the cylinder therein in sealed engagement therewith at its other end; and a second stopper adapted for mounting in the bore of the first stopper below the dispensing fitting in sealed engagement with the first stopper to seal off the piston cylinder chamber and included liquid component from the other component in the second chamber during storage and transport, the second stopper being ejectable from the bore of the first stopper after mounting therein into the second chamber upon actuation of the piston inwardly of the cylinder to communicate the two chambers for mixing the components in the second chamber.

DETAILED DISCUSSION

Figure 1:
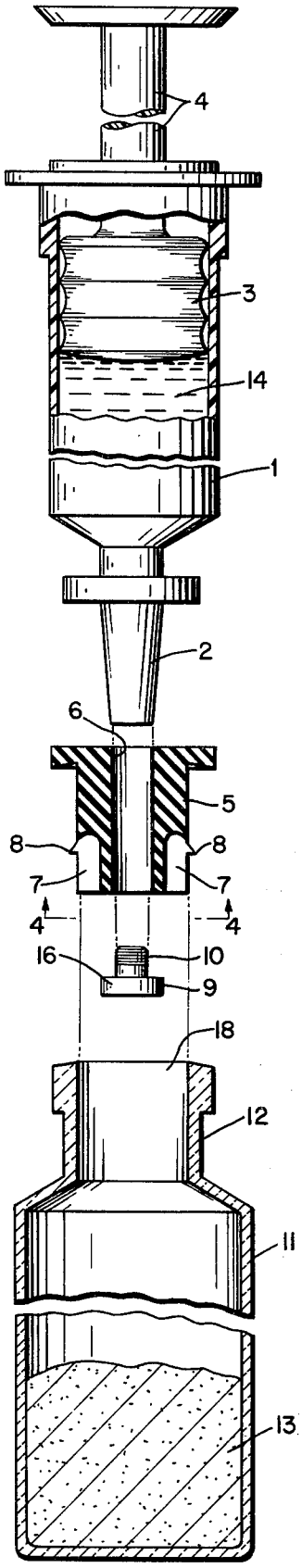
FIG. 1 is an exploded elevation, partially in section, showing the component parts of the syringe assembly and included components.

As shown in the drawings, a preferred embodiment of the device of this invention comprises:

a. one chamber consisting of a piston and cylinder syringe 1 adapted to hold a liquid 14, having an axially bored (not shown) dispensing fitting 2 forming frustoconical projection at one end thereof and closed at the opposite end thereof by a piston 3 with a plunger 4 mounted on the outward end of the piston, which is mounted slidably within the syringe;

b. a container 11 having an opening 18 at the neck 12 thereof and providing a second chamber adapted to hold a liquid or solid 13;

c. a first stopper 5 in the form of a sleeve having an axial bore 6, into one end of which the dispensing fitting or conical projection 2 of the syringe is adapted to fit to form a liquid-tight seal. The other end of the stopper 5 is adapted to fit within the neck 12 of the container 11 and has a plurality of optional recesses 7 in its exterior surface to allow processing of the first stopper on an automated lyophilizing plant.

Figure 4:
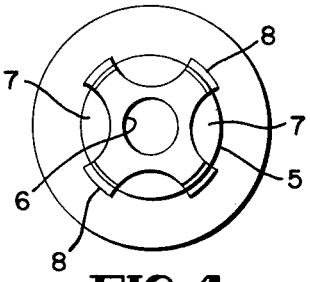
FIG. 4 is a plan view of the lower end of the sleeve stopper of the syringe assembly, from line 4 — 4 of FIG. 1.
Figure 5:
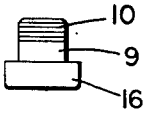
FIG. 5 is an elevation of the second stopper.

The end of the first stopper 5 into which the dispensing fitting is inserted has an optional ring bead which provides a stop to limit the distance into which the first stopper is inserted into the neck 12 of the container 11. Optionally, as shown in FIGS. 1 and 4, about one-third of its length from the end thereof adapted to be mounted in container 11, the first stopper 5 has a ring-shaped lamella 8 on its exterior surface in the form of a locking shoulder which provides a first stop when the stopper 5 is inserted in the neck 12 of the container 11, thus assuring that during the lyophilization of the content 13 of the container 11 the solvent vapours can pass through the recesses 7.

d. a second stopper 9 terminating in an optional ring bead 16 forming a cap on end of the stopper and having optional holding grooves 10 or lips on its exterior surface to facilitate engagement of the stopper with the bore 6 of said first stopper and adapted to fit into the end of the bore of the first stopper opposite the end thereof into which the dispensing fitting 2 of syringe 1 is fitted, to form a liquid-tight seal.

Figure 3:
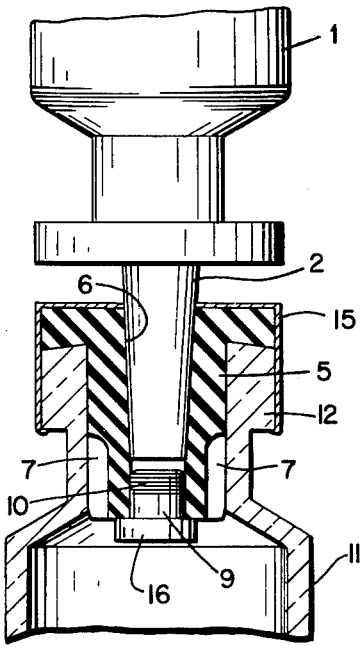
FIG. 3 is an enlarged fragmentary elevation of assembled syringe assembly.

Preferably, as shown in FIG. 3, the axially-bored dispensing fitting or conical projection 2 and the second stopper 9 are spaced apart. Preferably, the conical projection occupies at least two-thirds of the length of bore 6 and said second stopper less than one-third of the length of the bore. In the preferred embodiment of FIG.

3, the syringe assembly is provided with a metal retaining flange cap 15 to lock the first stopper in the container. This flange cap 15 possesses a central bore through which the conical projection 2 of the syringe 1 can pass. As an alternative embodiment (not shown) the flange cap 15 engages in the conical projection 2 of the syringe 1, thus locking the syringe to the stopper 5 and the container 11.

Figure 2A:
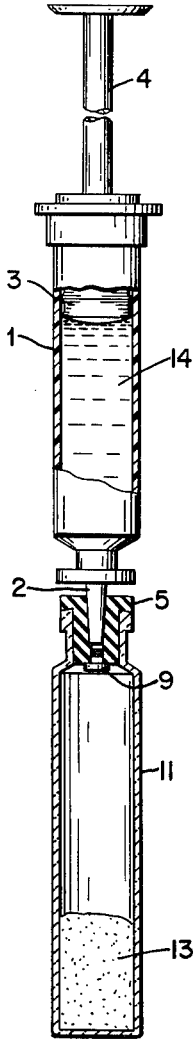
FIG. 2*a* is an elevation partially in section, of the assembled syringe assembly and included components positioned as stored and shipped.
Figure 2B:
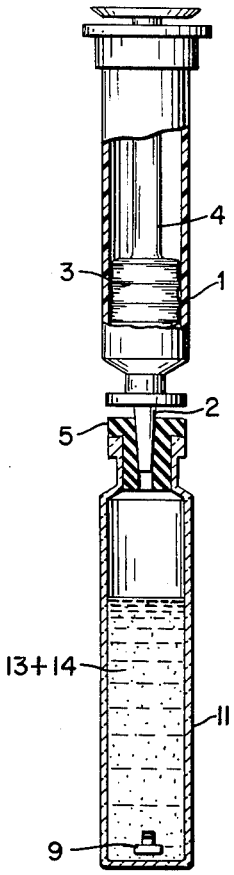
FIG. 2*b* is an elevation, partially in section, of the assembled syringe assembly, positioned after the mixing of the included components.

The filled and assembled two-chamber syringe is stored and shipped as shown in FIG. 2*a* so that all parts in or later coming into contact with the injection solution are protected against contamination. When the syringe is to be used, the piston 3 is pressed into the syringe 1 by pressure on the plunger 4. As a result of the pressure generated, the second stopper 9 is forced from its seating in the bore 6 into the container 11 and the liquid 14 in the chamber of syringe 1 then flows unhindered into container 11 to mix with the active material component 13 therein. The ready-to-use solution is then drawn back into the syringe 1.

The syringe 1 can then be removed from the stopper 5 and, after fitting an injection needle or cannula onto the conical projection 2, is ready for injecting the mixture into a patient.

Connecting the two chambers of the syringe, mixing of two components and drawing the ready-to-use solution into the injection syringe 1 thus takes only a few seconds and requires a minimum of technical expertise. This is an invaluable advantage, especially in an emergency situation. Moreover, the device is also extremely reliable and dependable.

Another advantage of the device of this invention is in the simplicity and economy of producing it. The piston syringe 1 and container 11 sub-assemblies can be known, commercially available parts.

The stoppers 5 and 9 are also do not present any extraordinary requirements and are simple and economical to obtain.

The bore 6 in the stopper 5 can be cylindrical as shown or conical to conform to the shape of the conical projection 2 of the piston syringe. However, for reasons of simplicity and economy of production, a cylindrical bore is preferred. Additionally, owing to a gripping effect, better seating of the piston syringe 1 in the stopper 5 is achieved.

As stated above, recesses 7 are preferably provided in the exterior surface of the end of the first stopper 5 which is inserted into the container 11. This is advantageous because the container can readily be fitted with the stopper combination 5, 9 without difficulty in an automated lyophilizing plant.

Thus, the filling of container 11 with active material 13 is done simply and with complete sterility.

Final assembly of the two-chamber syringe ready for use then is accomplished simply by fitting the dispensing fitting 2 of the syringe into the axial bore 6 of the first stopper 5.

The container 11 is usually made of glass, e.g., a conventional glass vial, since the glass is least likely to affect the second component 13 stored therein. However, other inert materials, e.g., synthetic resins, can be used.

The piston syringe 1 can also be made of glass or of an inert synthetic rigid resin, which is less prone than glass to breakage. A synthetic resin which has the least possible effect on the liquid 14 stored in the syringe 1 should be employed, e.g., polypropylene.

A somewhat softer, more elastic synthetic resin can be selected for the syringe piston 3, bearing in mind that it too must be substantially inert with respect to the liquid in the syringe, e.g., a synthetic caoutchouc like butyl rubber.

The first stopper 5 can be made of any natural or synthetic rubber which assures good sealing when the dispensing fitting 2 is seated in its bore and the strength necessary to retain the second stopper 9 in its bore. The material selected should also be substantially inert to the liquid 14 in the syringe.

The second stopper 9 preferably is made of a somewhat harder synthetic resin which is also medicinally unobjectionable and inert to the liquid 14.

The size of the container 11 and of the syringe 1 depend solely on the volume of the liquid 14 to be injected. In human medicine, 10 ml. is usually the upper limit so that container 11 and syringe 1 generally have volumes of up to 20 ml. each. However, in exceptional cases or in veterinary applications, larger syringes and containers can be used and also are usable without difficulty. There is no limitation whatsoever on the size or shape of container 11.

This invention is not limited by the nature of the two components which are stored in the two-chamber syringe and mixed therein, provided that at least one component, viz., stored in the syringe 1, is liquid.

Thus, this invention provides a device which permits injectable solutions to be prepared immediately before use, and which is rapid and dependable to use, and which is easy to produce and fill. The new syringe is most conveniently used as a disposable syringe, i.e., one which is discarded after one use.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A two-chamber syringe assembly for initially isolating a first liquid component to be provided in one chamber thereof from a second component to be provided in a second chamber thereof and thereafter mixing the two components; comprising a piston and cylinder type syringe having an axially-bored dispensing fitting at one end of the cylinder, with the cylinder forming a chamber for the liquid component when the piston is in outward retracted position at the opposite end of the cylinder; a container providing a second chamber for the second component and having an opening at one end; a first axially bored resilient stopper in the form of a sleeve, with one end thereof adapted for sealed engagement with the open end of the container and the bore thereof adapted to mounting the dispensing fitting of the cylinder therein in sealed engagement therewith at its other end; and a second stopper adapted to mounting in the bore of the first stopper below the dispending fitting in sealed engagement with the first stopper to seal off the piston cylinder chamber and included liquid component from the other component in the second chamber during storage and transport, the second stopper being ejectable from the bore of the first stopper after mounting therein into the second chamber upon actuation of the piston inwardly of the cylinder to communicate the two chambers for mixing the components in the second chamber.

2. The syringe assembly of claim 1 wherein one end of the second stopper terminates in a ring bead.

3. The syringe assembly of claim 1 wherein the second stopper has holding grooves or lips to facilitate engagement of the second stopper with the bore of said first stopper.

4. The syringe assembly of claim 1 wherein the first stopper has recesses in and a ring-shaped lamella on the exterior surface thereof which allow processing of the first stopper with the container on an automated lyophilizing plant.

5. The syringe assembly of claim 1 wherein a. one end of the second stopper terminates in a ring bead;

b. the second stopper has holding grooves or lips to facilitate engagement of the second stopper with the bore of the first stopper;

c. the first stopper has recesses in and a ring-shaped lamella on the surface thereof to allow processing of the first stopper with the container on an automated lyophilizing plant.

6. The syringe assembly of claim 1 assembled for storage and shipping, wherein the piston of the syringe is in outward retracted position, the first chamber contains a sterile liquid component and the second chamber contains a sterile second component; one end of the first stopper is mounted in sealed engagement in the open end of the container and the second stopper is mounted in sealed engagement in the bore of the first stopper at the same end thereof; and the dispensing fitting of the syringe is mounted in sealed engagement in the bore of the first stopper at the other end thereof.

7. The syringe assembly of claim 6 wherein the axially-bored dispensing fitting occupies at least two-thirds of the length of the bore of the first stopper and the second stopper less than one-third of the length of the bore.

8. The syringe assembly of claim 1 wherein the dispensing fitting and the second stopper are spaced apart in the bore of the first stopper.

9. The syringe assembly of claim 6 wherein a. one end of the second stopper terminates in a ring bead;

b. the second stopper has holding grooves or lips to facilitate engagement of the second stopper with the bore of the first stopper.

C. the first stopper has recesses in and a ring-shaped lamella on the surface thereof to allow processing of the first stopper with the container on an automated lyophilizing plant.

* * * * *